US005277049A

United States Patent [19]

Endo

[11] Patent Number: 5,277,049

[45] Date of Patent: Jan. 11, 1994

[54] RIVET SETTING DEVICE

[75] Inventor: Itsuo Endo, Shizuoka, Japan

[73] Assignee: Tokai Metallic Manufacturing Co., Ltd., Shizuoka, Japan

[21] Appl. No.: 971,296

[22] Filed: Nov. 4, 1992

[30] Foreign Application Priority Data

Feb. 4, 1992 [JP] Japan ..... 3-011005[U]

[51] Int. Cl.[5] ..... B21J 15/28

[52] U.S. Cl. ..... 72/391.4; 72/391.6; 29/243.53; 29/243.54; 29/812.5; 29/816

[58] Field of Search ..... 29/243.53, 243.54, 524.1, 29/812.5, 816; 72/391.4, 391.6

[56] References Cited

U.S. PATENT DOCUMENTS 3,432,925 3/1969 Woolley ..... 29/243.54
3,747,193 7/1973 Gregory ..... 29/243.53
4,039,099 8/1977 Boxall ..... 29/524.1

*Primary Examiner*—David Jones

*Attorney, Agent, or Firm*—Bauer & Schaffer

[57] ABSTRACT

A pneumatic cylinder and piston assembly is provided with a piston rod on the end of which is mounted a punch. The cylinder is provided with an extension tube through which the piston rod and punch extend. The assembly is mounted on a support frame have a bored body and a pair of spaced lateral brackets. The assembly is held in the body with the extension tube passing freely through the brackets. A die is mounted on the frame at a position in counter opposition to said punch whereby a rivet may be driven into materials to be joined and clinched by said punch on driving of said piston. The apparatus includes a stopper mounted about the piston rod to limit the movement of said piston rod in said cylinder and restrict the maximum protruded position of the punch, a spacer mounted about the extension tube and located between the body and the lower bracket to define the optimum driving of the punch, and a nut threaded over the extension tube for securing the extension tube to the lower bracket.

8 Claims, 10 Drawing Sheets

RIVET SETTING DEVICE

FIELD OF THE INVENTION

The present invention relates to apparatus for riveting sheet plates and more particularly to a rivet setting machine that self-pierces and clinches rivets into metal plates, plastic plates or the like that are to be jointed together.

DESCRIPTION OF THE PRIOR ART

A rivet setting device of the prior art is illustrated on FIGS. 1 to 4.

In the drawings, symbol 40 indicates a hydraulic cylinder, having an end cap 29 secured to its lower end to which is coupled an extension tube 25. A thread 25*a* is formed on the outer surface of the lower end of the extension tube 25. A guide bush 11 is located within the extension tube 25 and a bush 12 is mounted integrally with bush 11. A nose adaptor 5 is secured onto bush 12 and a nose insert 3 is fixed on the nose adaptor 5.

The hydraulic cylinder 40 contains a hydraulic piston 36 having a piston rod 36*a* extending therefrom on the end of which is connected a plunger 19 by connecting pin 27 so that the plunger 19 extends through the extension tube 25.

A punch 18 is located within the extension tube 25 as well as the guide bush 11 and 12. The punch 18 is secured onto the end of the plunger 19 by a punch stop screw 16 and guide screw 17 inserted into a long hole 101.

A coil spring 20 is wound about the plunger 19 between flange 19*a* at the upper end of the plunger 19 and the rear end of guide bush 11. This biases the plunger 19 upwardly towards the cylinder 40 by the force of coil spring 20.

The hydraulic cylinder 40 is connected to hydraulic hoses 100 which in turn are connected to a hydraulic pressure source, not shown on the drawings, to comprise the piston drive means.

A C-frame 53 is provided to hold the cylinder. At its upper end, the frame 53 has a hollow body 53*a* in which the extension tube 25 passes in a freely movable manner. A horizontal upper bracket 47 is secured by screw 102 to the upper part of C-frame 53. The bracket 47 is provided with a hole 47*a* through which extension tube 25 passes in a freely movable manner. A horizontal lower bracket 50 is provided with a threaded hole 50*a* which is secured to the threaded outer surface 25*a* formed on extension tube 25. Below the lower bracket 50, a nut 104 is tightened onto the threaded outer surface 25*a*.

A die 54 is mounted on the lower end of the C-frame 53 in opposition to the tip edge portion of punch 18.

At each end of the horizontal upper bracket 47 and the horizontal lower bracket 50, semi-circle cutouts 47*b* and 40*b* are respectively formed on to which mounting pieces 110 defining half round inner openings 110*a* are respectively secured, by screws, so that circular holes are formed by the cutouts 47*b*, 50*b* and the openings 110*a*. Entry tube 45 and exit tube 46 for a rivet belt 106 are respectively fit into these circular holes and are secured in a condition that they are tightly bridged between the upper bracket 47 and lower bracket 50. The rivet belt 106 containing, for example, 5 mm length rivets 108 is guided through entry tube 45, passing within the nose adaptor 5, and then is guided through exit tube 46.

As shown on FIG. 5, each rivet 108 is formed with a hollow cavity 108*a*.

The function of the known rivet setting device is now explained:

Hydraulic pressure is applied to the hydraulic cylinder 40 through the hydraulic pressure hose 100 from the source having a pressured media so that hydraulic piston 36 is projected outwardly from the cylinder forcing the hydraulic piston 36, piston rod 36*a*, plunger 19 as well as punch 18 downwardly. Then, as shown in FIG. 6, the punch 18 causes the rivet 108 to pierce through metal plates 120 and 121 which are clinched in a manner that lower metal plate 121 is deformed and the lower end of rivet 108 and the metal plate 121 is pressed against the die 54 to effect a clinching action.

When the metal plates are made of, for example, aluminum, steel or the like and are to be clinched by a 5 mm rivet 108, the hydraulic pressure is set around 200 $kgf/cm^2$, while the hydraulic pressure can be set at around 110 $kgf/cm^2$ when 3 mm rivets are employed. The rivet piercing and clinching conditions may be adjusted so that the hydraulic pressure unit pressure control switch is turned off when a preset hydraulic pressure is attained.

In the prior art, the rivet drive and clinching conditions are otherwise adjustable only by changing the hydraulic pressure. This gives rise to the problem that the piercing and clinching conditions of rivet 108 cannot be maintained uniform due to influences of variations in the hardnesses of metal plates 120, 12 or the hydraulic oil temperatures. In other words, since the hardnesses of the metal plates 120, 121 varies over its area, the rivet 108 may not be completely driven in at portions with high hardness, while contrarily, at the low hardness portions the rivet 108 tends to bite deeply into the metal plates so that cracks or warp may occur on the metal plates 120, 121. Particularly, when metal plates made of reprocessed material are involved, there is the tendency that considerable variation in hardness occurs over the area of the plate so that there is great fear that the rivet 108 may not be adequately driven at all.

Further, since the viscosity of the oil within the hydraulic pressure unit varies dependent on the temperature involved, the hydraulic pressure will vary in response to the oil temperature. Accordingly, the pressure force of punch 18 will also vary so that the rivet 108 cannot be consistently driven into metal plates 120, 121, in an adequate condition.

In addition, when the distance between punch 18 and the die 54 is changed in order to accommodate different rivet lengths or metal plate thicknesses and the extension tube 25 is rotated within the cylinder 40 so as to lift or lower the punch relative to the die 54, the hydraulic hoses 100 must be detached from hydraulic cylinder 40. This is inconvenient and complicates the task of using the rivet setting apparatus.

OBJECTS AND SUMMARY OF THE INVENTION

Accordingly, in view of the problems inherent in the prior art, it is an object of the present invention to provide an improved rivet setting device which can obviate the shortcomings.

According to an aspect of the present invention, a rivet setting device is provided that comprises a cylinder, a piston accommodated in the cylinder, a piston rod to which the piston is attached, drive means for driving the piston, a punch driven together with the piston. An extension tube have a screw thread formed at the outer circumference and is connected to the cylinder. The extension tube is held in a frame having a through-hole body into which the extension tube passes. The frame includes an upper tube brackets having formed therethrough a through-hole through which the extension tube passes. The extension tube is secured in positioned so that the punch may protrude below the lower bracket. The upper tube bracket and the lower tube bracket are joined by a bridge member, and a die is mounted on the lower end of the frame at a position to counter face the tip edge of the punch so that a rivet may be driven into materials to be joined and clinched by the punch. The device is constructed and the through-hole of the lower tube bracket is selected so that the extension tube can freely pass therethrough. The device is also provided with a stopper to restrict the maximum protruded position of the punch at a predetermined position, a spacer into which the extension tube is inserted and located between the through-hole body and the lower tube bracket to position the extension tube such that at the maximum protruded position of the punch the rivet is driven and the clinching takes place satisfactorily, and a nut installed on the screw of the extension tube at the opposite side of the spacer through the lower tube bracket.

BRIEF DESCRIPTION OF THE DRAWINGS

A better understanding of the objects, features and advantages of the invention can be gained from a consideration of the following detailed description of the preferred embodiment thereof, in conjunction with the figures of the accompanying drawings through which like references designate the similar elements, wherein.

DETAILED DESCRIPTION OF THE PREFERRED EMBODIMENT

An embodiment of the rivet setting device according to the present invention is described with reference to FIGS. 7 to 16. Since the overall construction of the rivet setting device according to the present invention includes, in part, the same elements or portions as those of the rivet setting device according to the prior art mentioned above, explanations for the same or similar parts shall be omitted for convenience and the numerals for such similar parts shall be the same as in FIGS. 1–6.

Figure 1:
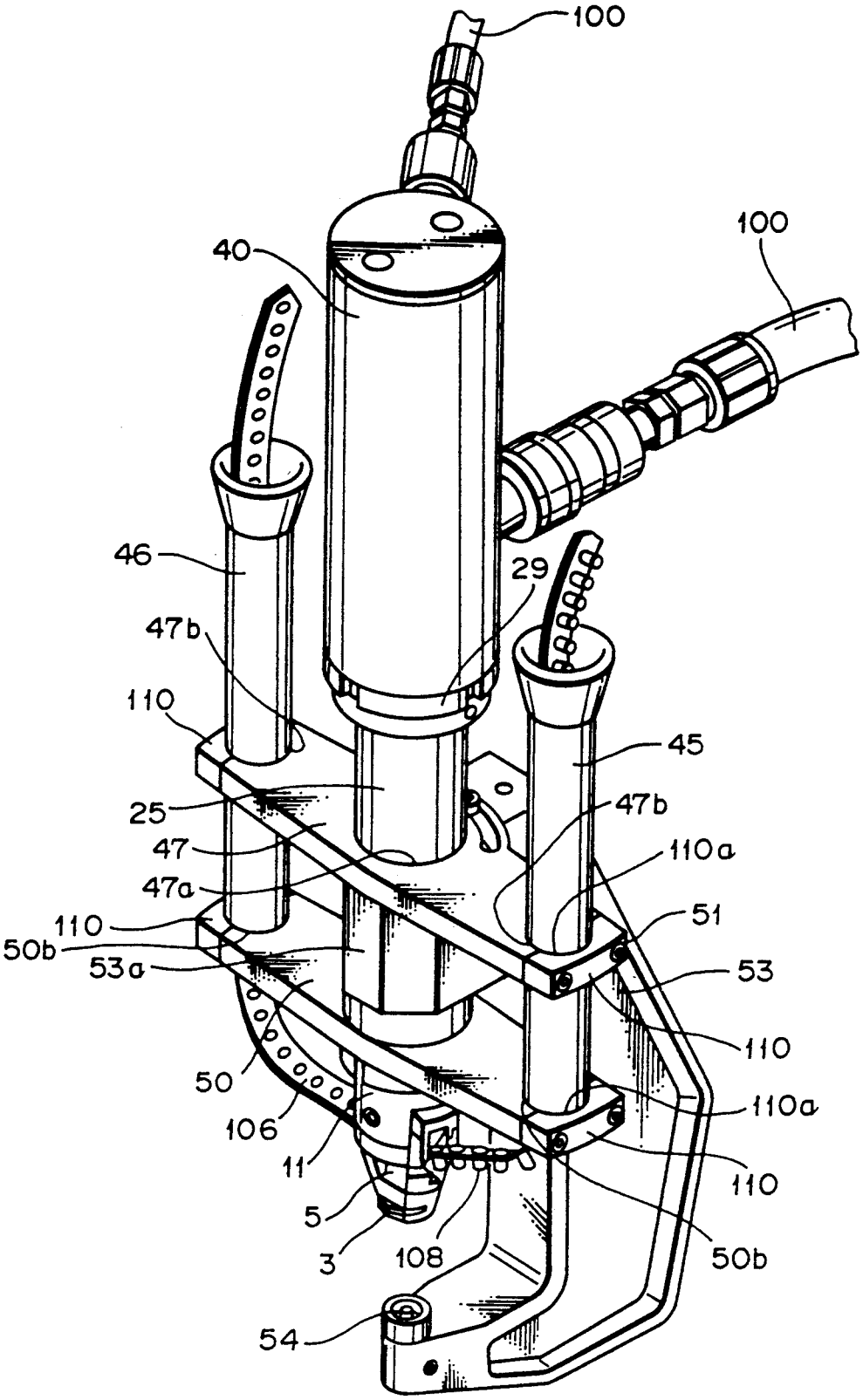
FIG. 1 (PRIOR ART)
FIG. 1 is a perspective view of a rivet setting device according to the prior art.
Figure 2:
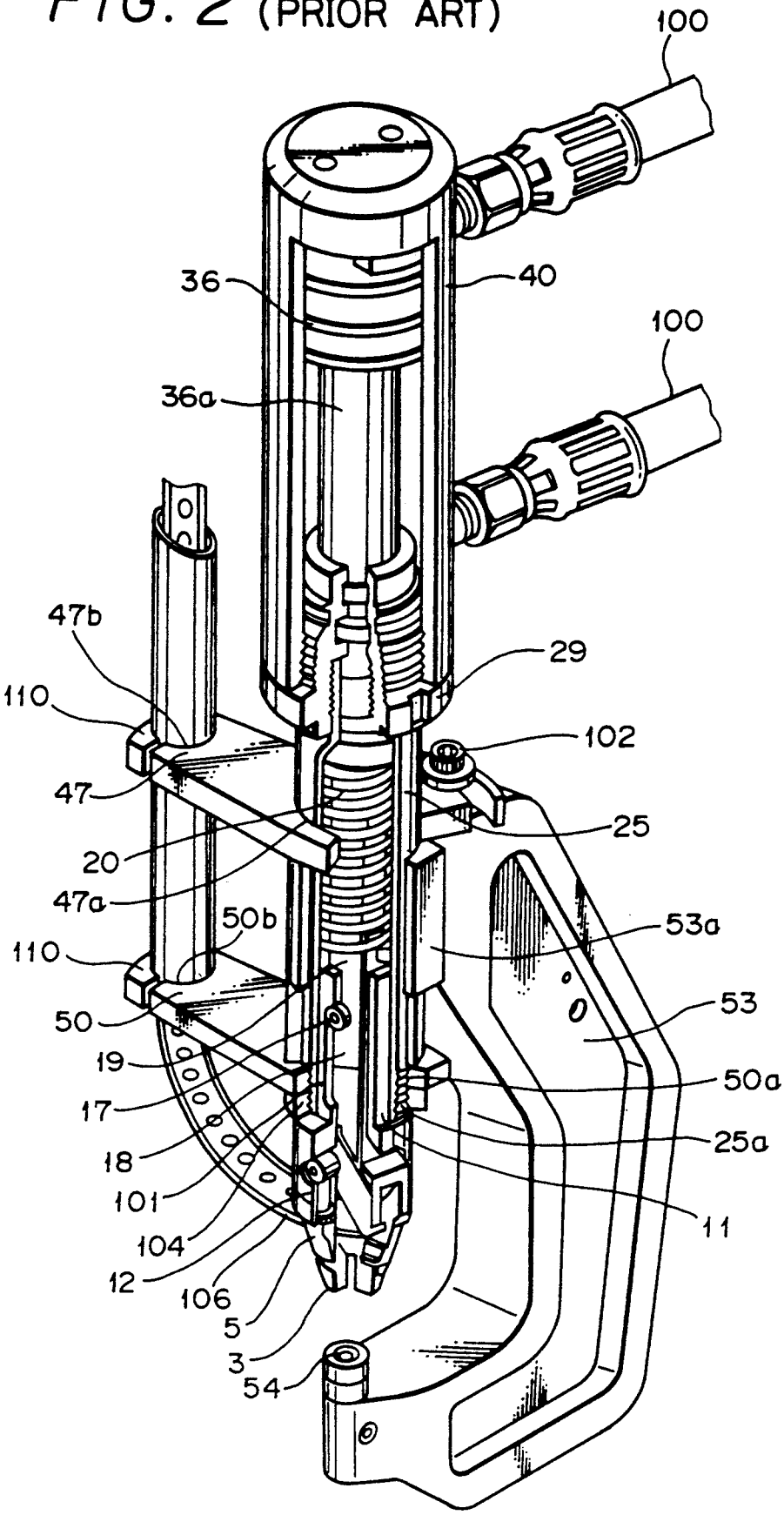
FIG. 2 (PRIOR ART)
FIG. 2 is a view similar to that of FIG. 1, partially sectioned to show the interior of the device according to the prior art.
Figure 3:
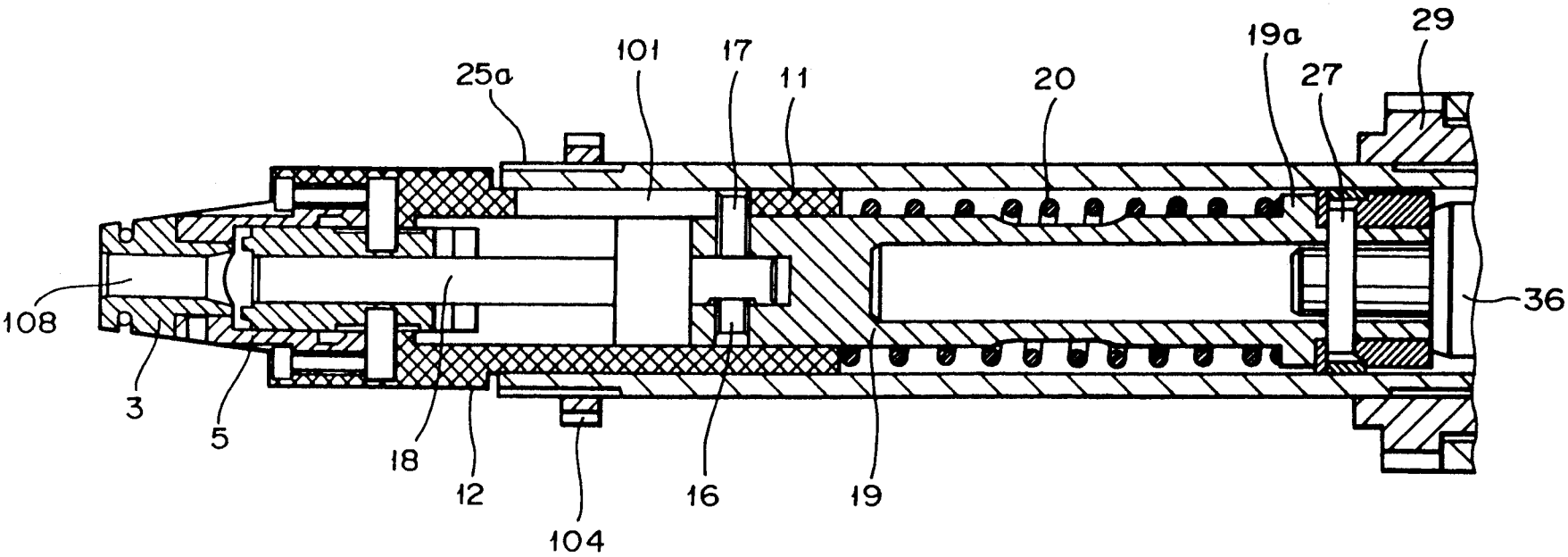
FIG. 3 (PRIOR ART)
FIG. 3 is a longitudinal cross sectional view of the tip portion of the device according to the prior art.
Figure 4:
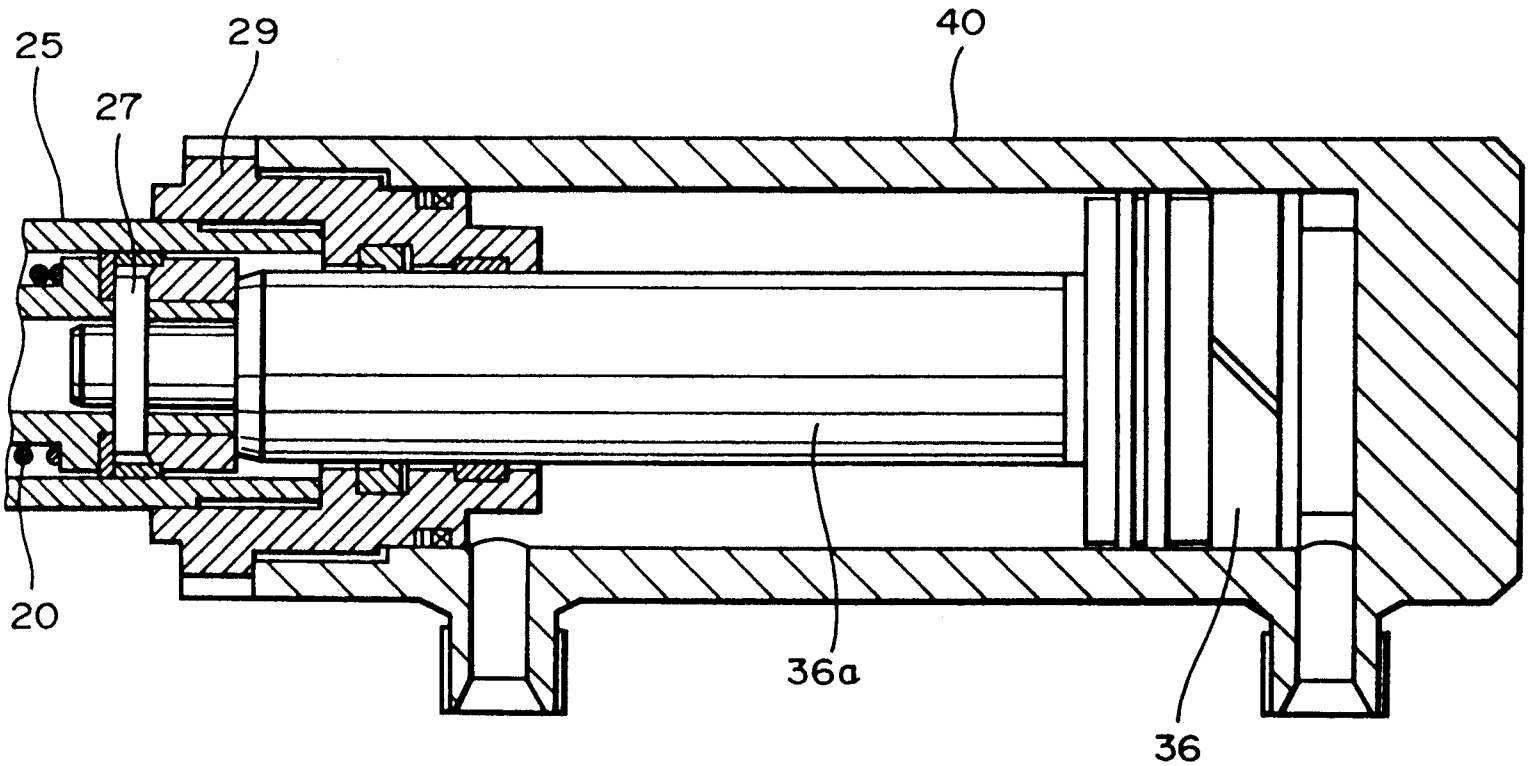
FIG. 4 (PRIOR ART)
FIG. 4 is a longitudinal cross sectional view of the rear end of the device according to the prior art.
Figure 5:
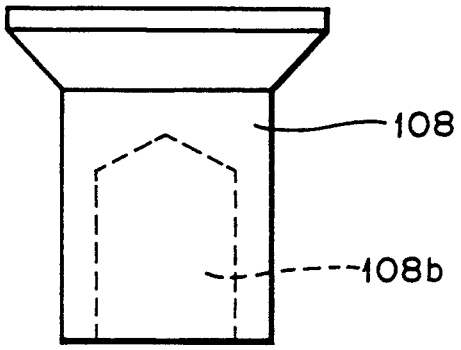
FIG. 5 is a front elevational view of a rivet.
Figure 6:
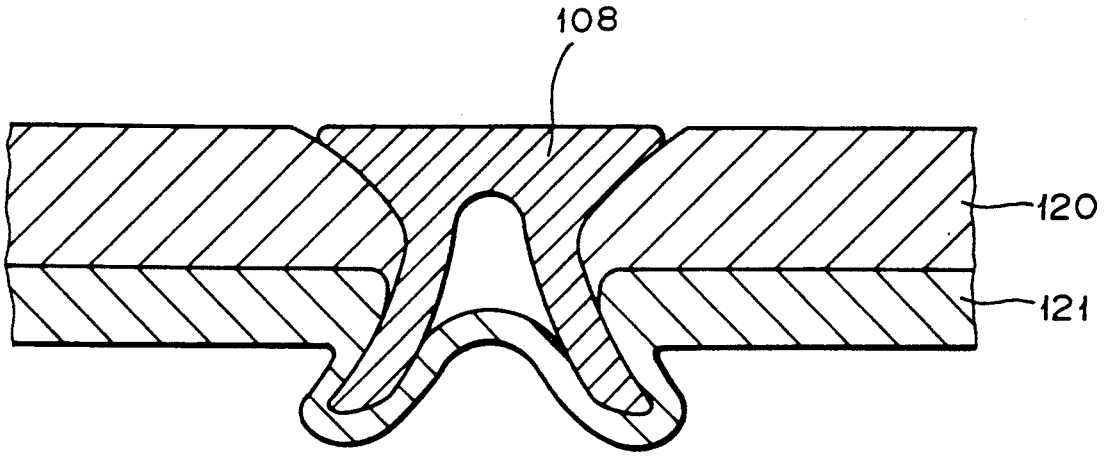
FIG. 6 is a cross sectional view of clinched metal plates.
Figure 7:
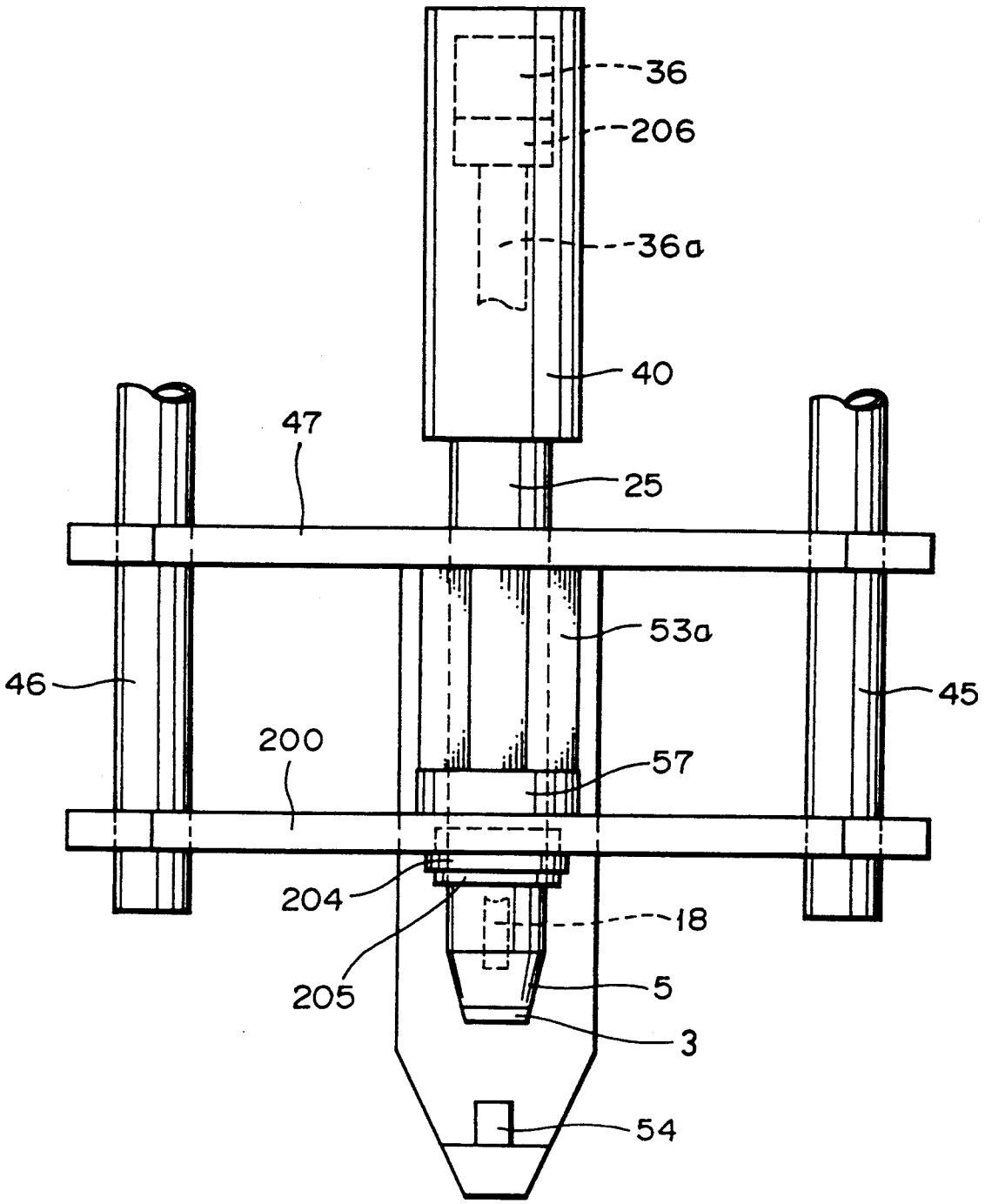
FIG. 7 is a front elevational view of a rivet setting device according to the present invention.
Figure 8:
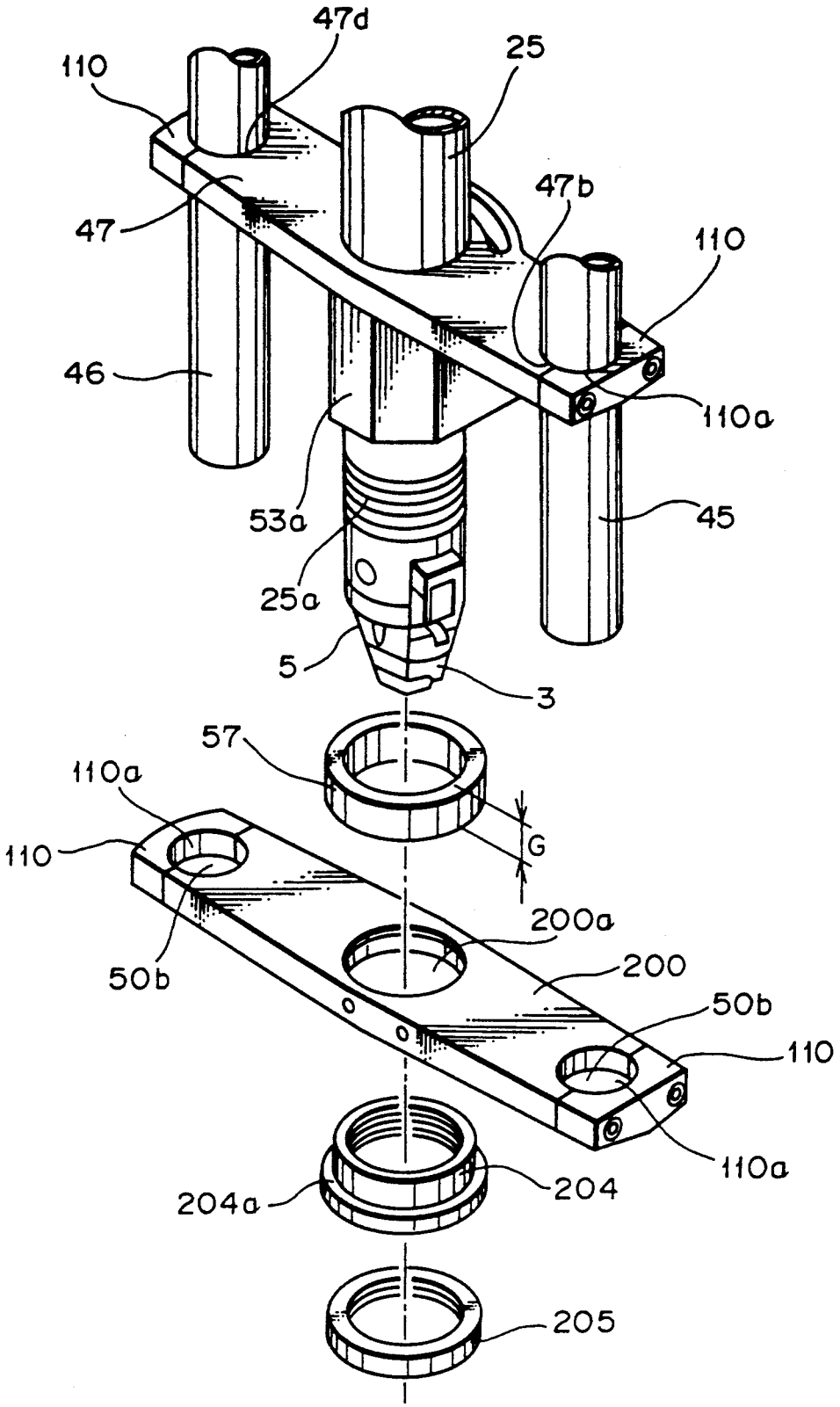
FIG. 8 is a partially exploded perspective view of the rivet setting device according to the present invention.
Figure 9:
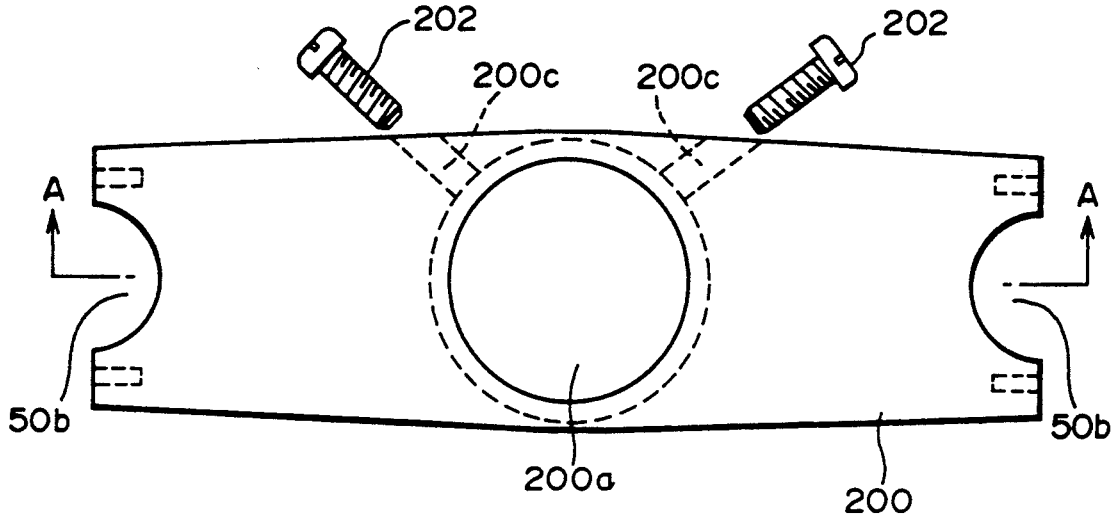
FIG. 9 is a plan view of a lower bracket of the present invention.
Figure 10:
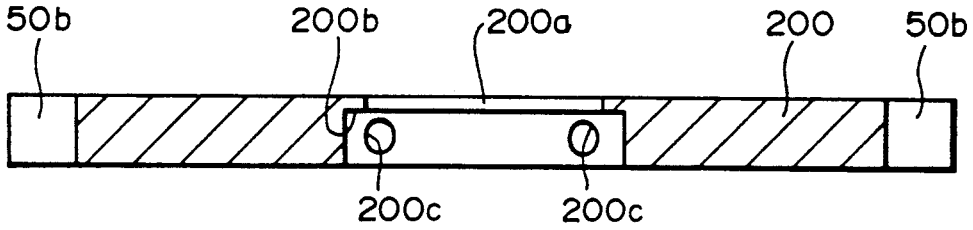
FIG. 10 shows a cross sectional view taken along line A—A in FIG. 9.
Figure 11:
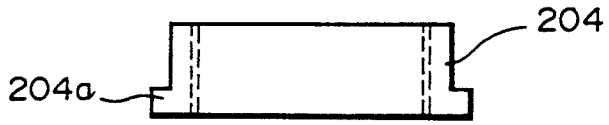
FIG. 11 is a front elevational view of a clinch interference control nut of the device according to the present invention.
Figure 12:
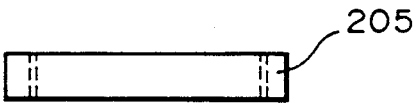
FIG. 12 is a front elevational view of a double nut used according to the present invention.
Figure 13:
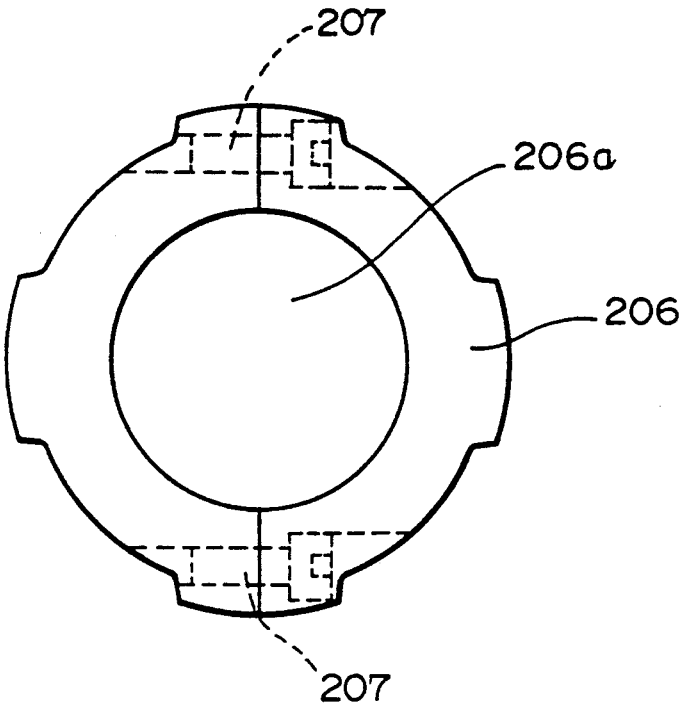
FIG. 13 is a plan view of a spacer used in the device according to the present invention.
Figure 14:
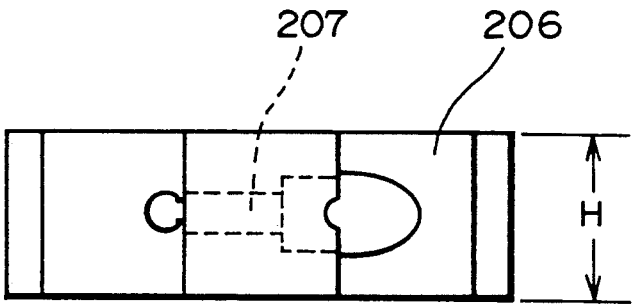
FIG. 14 is a front elevational view of the spacer of FIG. 13.

As seen in FIGS. 7 to 9 the frame comprises a horizontal lower bracket 200 having a central hole **200*a* through which passes the extension tube 25 in a freely movable manner. The hole 200*a* is formed so that its inner diameter mid way down from the top surface to form a shoulder 200*b* therein (see FIG. 10). Threaded holes 200*c* open from the front edge surface of the lower bracket 200 into the hole 200*a* and receive screws 202 respectively (FIGS. 9 and 10). A nut 204 is threadedly mounted on screw 25*a* of the extension tube 25. As seen in FIG. 11*a*, flange 204*a* is formed around the lower peripheral edge of the nut 204. The nut 204 is placed on the extension tube 25 from below the lower bracket thereby sealing and determining the length of the tube extending below the lower bracket. A double nut 205 is mounted on screw 25*a* of the extension tube 25 beneath the nut 204 to lock nut 204 in place. A stopper 206 having a hole 206*a* is placed over the piston rod 36*a*. The stopper 206 can be formed as two semi-circular pieces and assembled using screw bolts 207 as seen in FIGS. 13 and 14** and adjusted to determine the maximum stroke of the piston rod.

Assembly of the rivet setting device is accomplished by mounting the stopper 206 in a manner that the piston rod **36*a* passes through the hole 206*a* thereof, and is secured in a condition that it contacts the lower surface of hydraulic piston 36. Since the stopper 206 can be divided into two pieces, it can be easily installed on piston rod 36*a***.

The thickness H of stopper 206 (FIG. 14) is selected so as to restrict the position taken by the punch 18 when the plunger is extended to is maximum. Thus, as the hydraulic piston 36 moves downwardly and the stopper 206 comes into contact with the rear end portion of the end cap 29 of the cylinder 40 further movement of the hydraulic piston 36 will be halted and the extended position of the punch 18 will be at its maximum protruded position.

Next, the adjustment of the distance between the tip end of punch 18 and the die 54 is made. As shown on FIG. 8, the extension tube 25 passes through the horizontal upper bracket 47 as well as through the bore of the hollow body **53*a* of the C-frame 53. Also, a ring type spacer 57 is placed between the body 53*a* and the lower bracket 200. The nut 204 and double nut 205 are then installed on the screw 25*a*. Screws 202 are screwed into threaded holes 202*c* of the lower bracket 200, respectively, and the nut 204 is tightly secured to bracket 200. As the next step, the entry tube 45 and exit tube 46 are secured to the upper and lower bracket 47**.

Since the lower bracket 200 and the nut 204 are secured jointly to screw **25*a* of extension tube 25 there is no fear that the extension tube 25 will dislodge, descend or rotate even when the device is oriented so that the punch 18** protrudes in a counter gravity direction or horizontal direction.

The thickness G of spacer 57 is selected to be equal to the thickness dimension H of stopper 206. Accordingly, the extension tube 25 is secured at a position which is down by the same distance as the protruding distance of the punch 18 which is reduced by the stopper 206.

The fine adjustment of the installation position of extension tube 25 is carried out by rotating the nut 204.

Further, by adjusting the extension tube 25 in its position relative to the lower bracket 200 so that the protruding distance of the punch 18 is held to a minimum and by taking the punch 18 as close as possible to the metal plate 120, the operating range of the punch 18 is reduced so that time cycle of the operation is shortened.

The hydraulic pressure of the hydraulic drive unit may be held at 200 kgf/cm$^2$ for both 5 mm rivets as well as 3 mm rivets. The hydraulic pressure is preferably best set at the pressure that is sufficient to drive and clinch or seal the longest rivet that is to be used so that the hydraulic pressure adjustment need not be necessary each time the rivet is changed.

Figure 15:
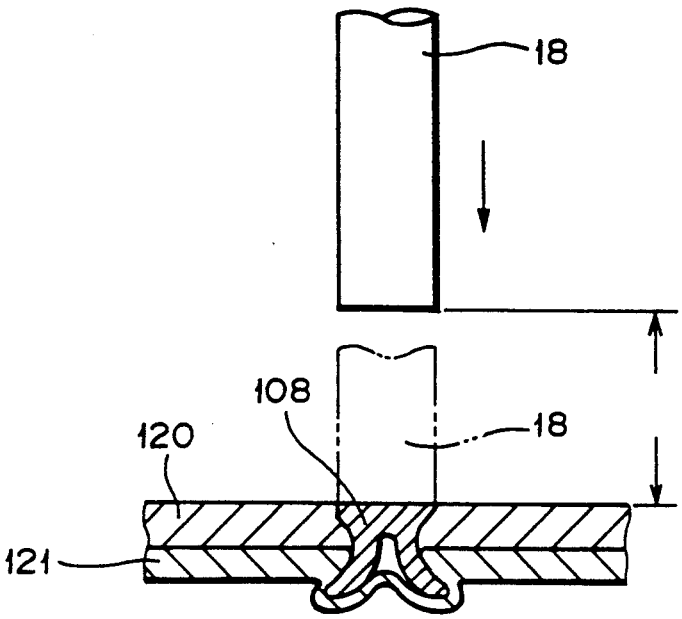
FIG. 15 is a diagram showing the function of the punch according to the present invention.
Figure 16:
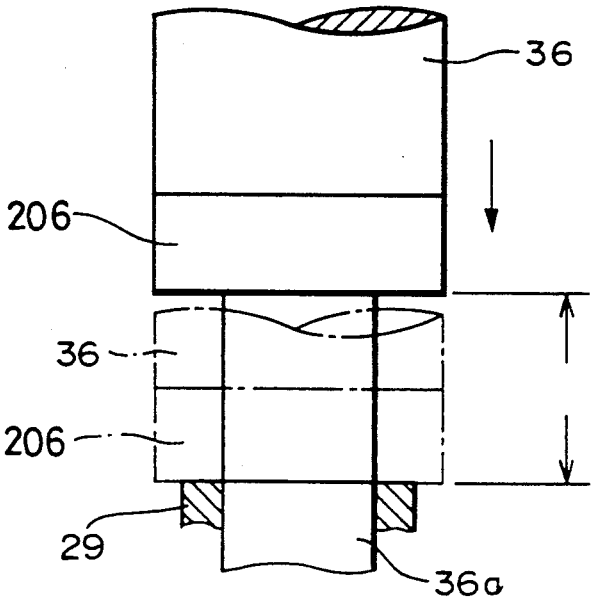
FIG. 16 is a diagram showing the function of the stopper as it contacts the end cap.

In operation, hydraulic piston 36 is driven by hydraulic pressure to make punch 18 function to drive 5 mm rivets 108 into metal plates 120, 121 and clinch the same, as shown in phantom in FIG. 15. When punch 18 arrives at the maximum protrusion, the stopper 206 and the rear end of the end cap 29 are in contact as shown in phantom in FIG. 16. Therefore, punch 18 will steadily maintain a constant protrusion length, while the pressure force thereof becomes zero at the maximum protrusion condition. Consequently, there will be no occurrence of excessive driving of the rivet 108. Also, since the punch 18 will protrude with sufficiently large drive pressure when the stopper 206 contacts the end cap 29, the rivet 108 will be positively driven into metal plates 120, 121.

When 3 mm rivets are used, the punch, nose adaptor and nose insert will have to be changed to those for the 3 mm application. The stopper 206 is also changed to one for the 3 mm rivet use as well as spacer 57. The hydraulic pressure is left at 200 kgf/cm$^2$. In this case, when the punch protrudes as preset, the stopper and the rear end of end cap 29 come into contact. Accordingly, the punch will steadily maintain a constant protrusion without excessively driving the rivet, while the punch is driven with sufficiently large drive pressure until the stopper contacts the rear end of end cap 29, so that the rivet is positively driven into the metal plates.

According to the above described embodiment of the present invention, regardless of the variations in the hardness of the joined materials or temperature changes in the hydraulic oil, the rivets can be driven into the materials to be joined in an adequate and correct condition to form the clinch, and further, the work involved to change the distance between the punch and die can be conducted simply.

It should be understood that the above description is presented by way of example on the preferred embodiment of the invention and it will be apparent that many modifications and variations thereof could be effected by one with ordinary skill in the art without departing from the spirit and scope of the novel concepts of the invention so that the scope of the invention should be determined only by the appended claims.

What is claimed is

1. In a rivet setting device comprising a pneumatic cylinder and piston accommodated in said cylinder, having a piston rod attached to said piston and a punch mounted at its end, drive means for driving said piston, and an extension tube connected to said cylinder through which said piston rod extends and said punch protrudes a threaded section formed circumferentially around the outer surface of said extension tube a frame comprising a body having a bore through which said extension tube passes, an upper bracket having a hole through which said extension tube passes and a lower tube bracket having a threaded hole through which said extension tube passes and a die mounted on said frame at a position in counter opposition to said punch, wherein a rivet may be driven into materials to be joined and clinched by said punch, on driving of said piston, the improvement comprising:

a stopper mounted about said piston rod within said cylinder in contact with the lower surface of said piston to limit the movement of said piston rod in said cylinder to restrict the maximum protruded position of said punch to a predetermined position;

a spacer mounted about said extension tube and located between said body and said lower tube bracket to position said extension tube such that at the maximum protruded position of said punch optimum driving and clinching of the rivet takes place; and a nut screwed onto the threaded section of said extension tube on the side of said lower tube bracket, opposite to said space, the through-hole of said lower tube bracket being formed such that said extension tube freely passes therethrough said nut permitting adjustable positioning of said extension tube.

2. The rivet setting device as claimed in claim 1, in which said hole of said lower tube bracket has different inner diameter portions to provide a step therein.

3. The rivet setting device as claimed in claim 2, in which said nut has formed around its lower peripheral edge a flange and is engaged with said hole in said lower tube bracket.

4. The rivet setting device according to claim 1 including a double nut which is screwed onto a tip end of said threaded section of said extension tube under said nut.

5. The rivet setting device as claimed in claim 1, in which said stopper has a hole in which said piston rod is inserted.

6. The rivet setting device as claimed in claim 5, in which said stopper is formed of two semi-circular parts which are assembled by a screw bolt.

7. The rivet setting device as claimed in claim 2, in which said lower tube bracket is formed with at least one screw-hole extending laterally in the said hole in said lower tube bracket and having a screw bolt inserted into said at least one screw-hole, to be urged at a tip end thereof against said nut to thereby fix said extension tube to said lower tube bracket.

8. A rivet setting device as claimed in claim 1, in which said spacer and said stopper are selected equal in thickness.

* * * * *